US010030341B1

(12) United States Patent
Burger

(10) Patent No.: US 10,030,341 B1
(45) Date of Patent: Jul. 24, 2018

(54) COMPACTOR DRUM SHELL ASSEMBLY

(71) Applicant: Caterpillar Paving Products Inc., Brooklyn Park, MN (US)

(72) Inventor: Tyler Scott Burger, Plymouth, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/407,542

(22) Filed: Jan. 17, 2017

(51) Int. Cl.

| | |
|---|---|
| ***E01C 19/00*** | (2006.01) |
| ***E01C 19/23*** | (2006.01) |
| ***E01C 19/26*** | (2006.01) |
| *E01C 19/28* | (2006.01) |

(52) U.S. Cl.
CPC ..... *E01C 19/236* (2013.01); *E01C 19/23* (2013.01); *E01C 19/26* (2013.01); *E01C 19/282* (2013.01)

(58) Field of Classification Search
CPC ..... E01C 19/23; E01C 19/236; E01C 19/26; E01C 19/263
USPC ..... 404/117, 122, 124
See application file for complete search history.

(56) References Cited

U.S. PATENT DOCUMENTS

| | | | | |
|---|---|---|---|---|
| 1,560,295 A * | 11/1925 | Keeler | E01C 19/43 | 180/16 |
| 2,132,955 A * | 10/1938 | Johnson | B60B 15/26 | 301/40.5 |
| 2,136,975 A * | 11/1938 | Keeten | B60B 15/26 | 301/39.1 |
| 2,991,836 A * | 7/1961 | Swanson | A01B 29/04 | 172/545 |
| 3,483,806 A | 12/1969 | Williamson et al. | | |
| 4,632,599 A | 12/1986 | Sadahiro | | |
| 5,511,901 A | 4/1996 | Yates | | |
| 6,390,204 B1 * | 5/2002 | Schafle | E02D 3/026 | 172/554 |
| 6,409,420 B1 * | 6/2002 | Horton | E01F 13/123 | 404/6 |

(Continued)

FOREIGN PATENT DOCUMENTS

| | | |
|---|---|---|
| DE | 29505383 | 8/1995 |
| WO | WO2012125907 | 9/2012 |

OTHER PUBLICATIONS http://www.elliotattach.com/gallery.html, "Elliot Attachments", Elliot, viewed on Oct. 7, 2016.

*Primary Examiner* — Raymond W Addie
(74) *Attorney, Agent, or Firm* — Miller, Matthias & Hull

(57) ABSTRACT

A removable drum shell kit for a compactor drum includes a plurality of links coupled together. The plurality of links includes a longitudinal member having an inner surface contacting the compactor drum and an outer surface contacting a ground surface. The plurality of links includes at least one cleat assembly coupled to the outer surface of the longitudinal member. The plurality of links includes at least one first coupling member coupled to the longitudinal member extending towards a first side of the longitudinal member and at least one second coupling member coupled to the longitudinal member extending towards a second side of the longitudinal member. The first coupling member is coupled to a corresponding second coupling member of another link towards the first side of the link, and the second coupling member is coupled to a corresponding first coupling member of another link towards the second side of the link.

20 Claims, 10 Drawing Sheets

(56) References Cited

U.S. PATENT DOCUMENTS

| | | | | |
|---|---|---|---|---|
| 9,127,428 | B2 * | 9/2015 | Meier | E02D 3/026 |
| 2014/0062166 | A1 | 3/2014 | Crystal et al. | |
| 2016/0047103 | A1 | 2/2016 | Pratt | |

* cited by examiner

COMPACTOR DRUM SHELL ASSEMBLY

TECHNICAL FIELD

The present disclosure relates to a vibratory compactor drum. More specifically, the present disclosure relates to a drum shell kit replacement for the vibratory compactor drum.

BACKGROUND

A vibratory compactor is commonly used to pack down soil or various other materials and hence increase a load supporting capacity of materials. For example, a compactor may be used at a construction site to compact earth, including dirt and rock. Compactors typically have two cylindrical tires and one large drum that are used to crush the soil as the compactor is moved throughout the job site.

In the case of soil compactors, cleats may be supported about external surfaces of the drum to improve compaction and/or traction capabilities of the ground engaging drum of the compactor. Surfaces of the compactor drum, and other ground engaging surfaces of the compactor tires, are subject to wear that, over time, may degrade performance of the compactor. Generally, the compactors are provided with a drum shell kit which includes cleats. Structurally, the drum shell kit comprises two semi-circular parts and the cleats, or "padfoot", are provided on ground engaging surface of the drum shell kit.

After the cleats get worn out, the drum shell kit needs to be replaced. An existing method to replace the drum shell kit requires the compactor to be taken to a workshop. A lifting mechanism, such as a crane, lifts up the compactor and the drum shell kit is replaced. A lot of tooling and equipment such as the crane, jacks etc. are required to perform the replacement. Further, the unused drum shell kits have considerable size and take up a lot of space in the workshop. Taking the compactor to the workshop from the worksite, every time when the drum shell kit needs to be replaced, causes substantial downtime and the availability of the machine is greatly reduced.

Thus, an improved design of the drum shell kit is needed so as to facilitate an easy removal and replacement of the drum shell kit on the compactor drum.

SUMMARY

In an aspect of the present disclosure, a removable drive on drum shell kit for a compactor drum is provided. The drive on drum shell kit includes a plurality of links coupled together to form the drum shell kit. The plurality of links includes a longitudinal member having an inner surface adapted to contact the compactor drum and an outer surface adapted to contact a ground surface. The plurality of links includes at least one cleat assembly coupled to the outer surface of the longitudinal member. The plurality of links includes at least one first coupling member coupled to the longitudinal member towards a first side of the longitudinal member. The plurality of links further includes at least one second coupling member coupled to the longitudinal member towards a second side of the longitudinal member. The first coupling member is coupled to a corresponding second coupling member of another link towards the first side of the link, and the second coupling member is coupled to a corresponding first coupling member of another link towards the second side of the link.

In another aspect of the present disclosure, a compactor drum mountable on a yoke of a compactor machine is provided. The compactor drum includes drum supports mounted on the yoke. The compactor drum includes pod housings mounted to the drum supports. The compactor drum further includes a removable drum shell kit adapted to be wrapped around the drum. The drum shell kit has a plurality of links coupled together. The plurality of links includes a longitudinal member having an inner surface adapted to contact the compactor drum and an outer surface adapted to contact a ground surface. The plurality of links includes at least one cleat assembly coupled to the outer surface of the longitudinal member. The plurality of links includes at least one first coupling member coupled to the longitudinal member towards a first side of the longitudinal member. The plurality of links further includes at least one second coupling member coupled to the longitudinal member towards a second side of the longitudinal member. The first coupling member is coupled to a corresponding second coupling member of another link towards the first side of the link, and the second coupling member is coupled to a corresponding first coupling member of another link towards the second side of the link.

In yet another aspect of the present disclosure, a method for coupling a removable drum shell kit to a compactor drum is provided. The drum shell kit includes a plurality of links coupled together. The method includes laying out the plurality of links on a ground surface between a first link at a first end of the drum shell kit and a second link at a second end of the drum shell kit. The method includes positioning the compactor drum such that the compactor drum contacts the first link of the drum shell kit. The method includes coupling the first link of the drum shell kit with the compactor drum. The method includes driving the compactor drum over the drum shell kit from the first end towards the second end such that the drum shell kit gets wrapped around a circumference of the compactor drum. The method further includes coupling the second link to the first link.

DETAILED DESCRIPTION

Figure 1:
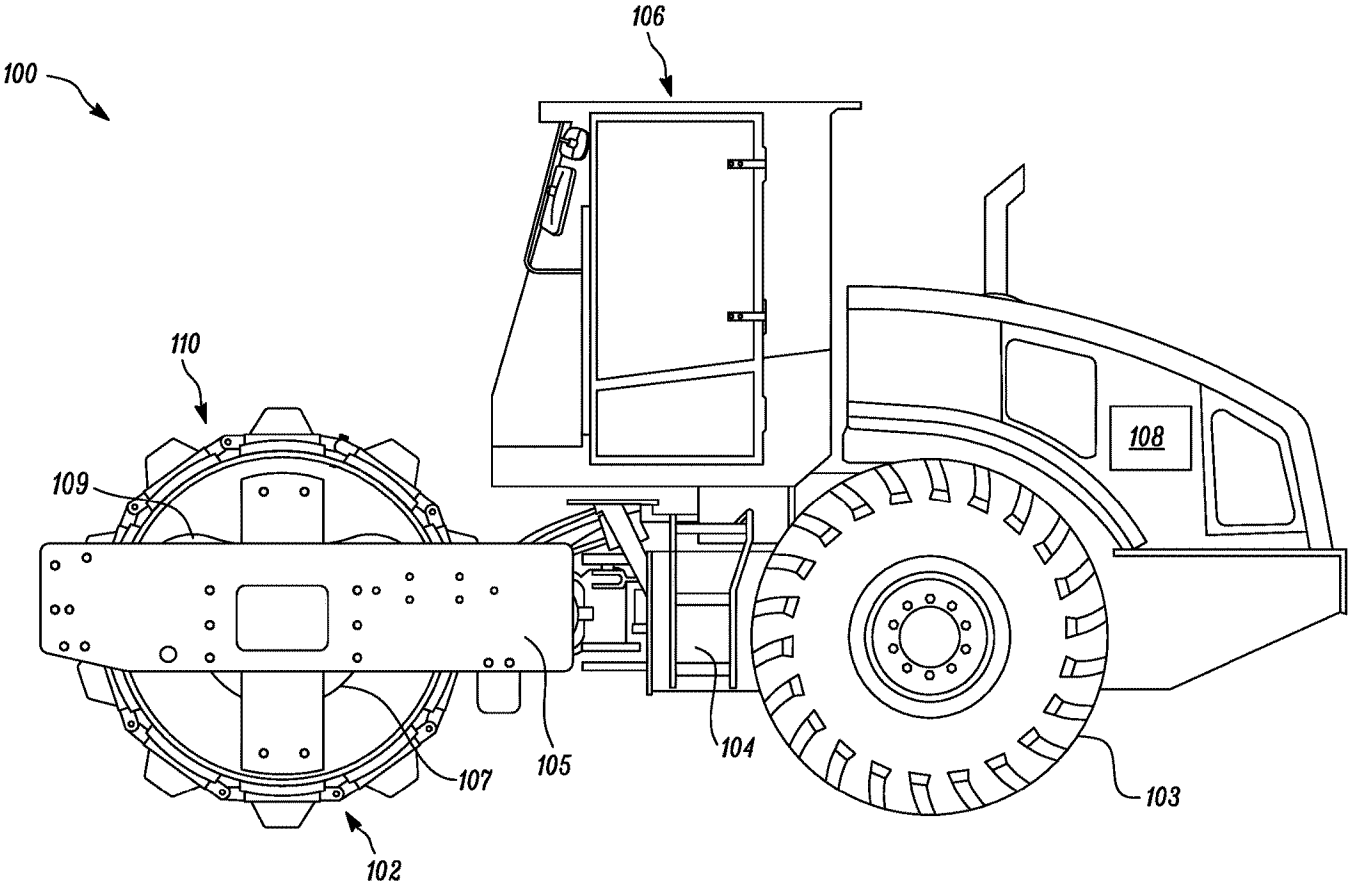
FIG. 1 is a side view of an exemplary compactor machine, in accordance with an embodiment of the present disclosure.

Wherever possible, the same reference numbers will be used throughout the drawings to refer to same or like parts. An exemplary embodiment of a compactor machine 100 is shown generally in FIG. 1. The compactor machine 100 shown in the FIG. 1 is a smooth drum type soil compactor with a drive on shell kit 110 installed. The compactor machine 100 may be used at a job site, such as a construction site, to compact materials, and may generally include a smooth compactor drum, or other similar ground engaging elements, such as a drum having cleats, or teeth. In the illustrated embodiment, the compactor machine 100 includes a compactor drum 102 and compactor wheels 103 as the ground engaging elements.

The compactor drum 102 is mounted on a yoke 105 of the compactor machine 100. The compactor drum 102 may be used to crush materials, such as, for example, soil, as the compactor machine 100 is moved throughout the work site. The compactor drum 102 includes a pod housing 107. The compactor drum 102 also includes drum supports 109. The drum supports 109 are mounted on the yoke 105. The pod housing 107 is mounted on the drum supports 109. The compactor machine 100 also includes a frame 104 for supporting the compactor drum 102, the compactor wheels 103 and other well-known components, such as an operator control station 106. The compactor machine 100 may also include an engine 108, such as an internal combustion engine, and a variety of mechanical, hydraulic and/or electrical systems for performing known functions. Such components and/or systems are well known to those skilled in the art and, therefore, will not be discussed herein in greater detail.

The compactor drum 102 further includes the drum shell kit 110. The drum shell kit 110 is removably coupled to the compactor drum 102. The drum shell kit 110 is used as an optional attachment to change the smooth compactor drum 102 to a padfoot compactor drum without having to change the entire compactor drum 102. Further, different types of the drum shell kits 110 may be used as per application requirements. The present disclosure discloses in the forthcoming description about structural details of the drum shell kit 110 as well as an efficient method to removably couple the drum shell kit 110 with the compactor drum 102.

Figure 2:
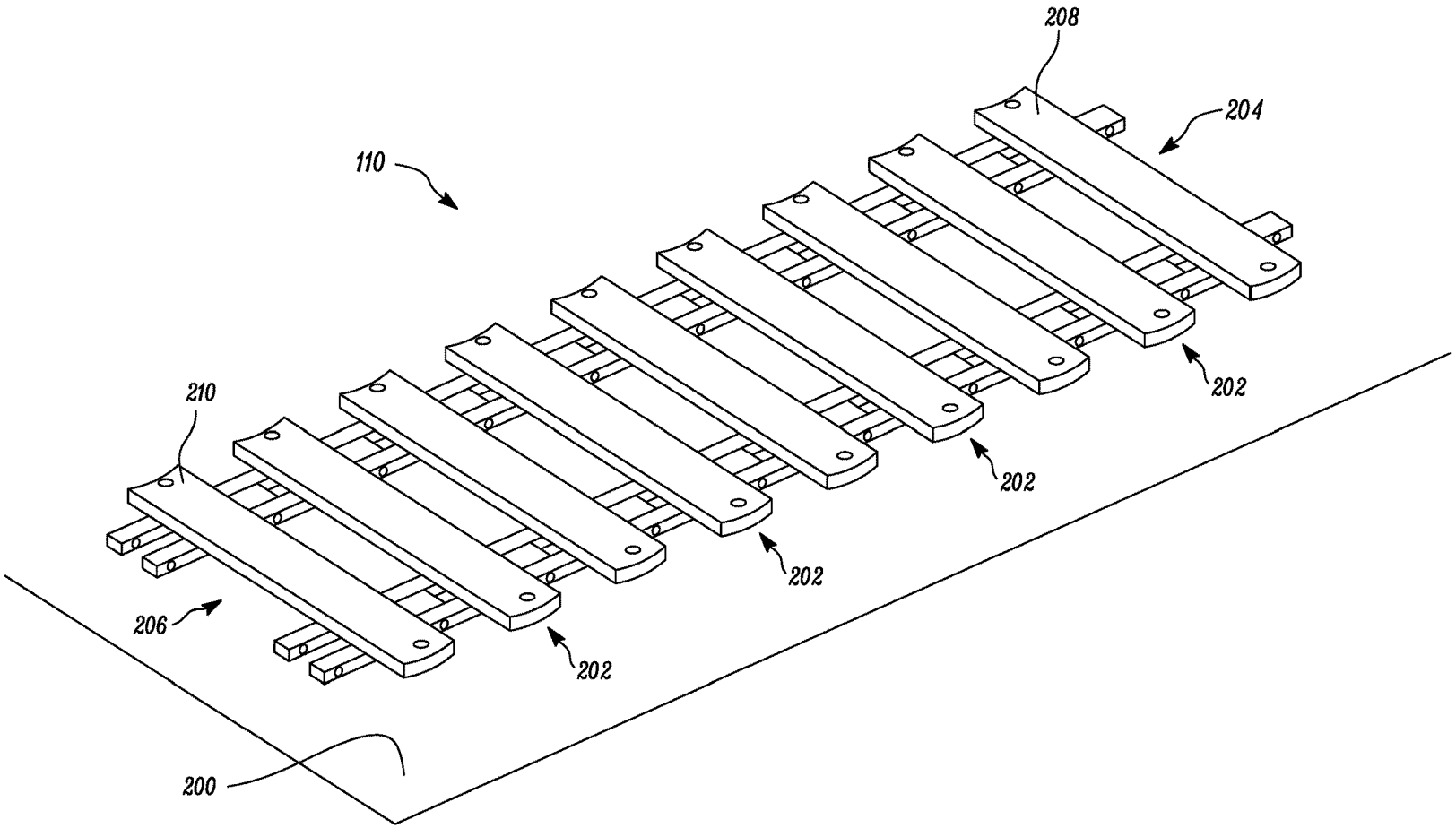
FIG. 2 is a perspective view of a drum shell kit laid out an a ground surface, in accordance with an embodiment of the present disclosure.

Referring to FIG. 2, the drum shell kit 110 is shown laid out on a ground surface 200 in a planar configuration. The drum shell kit 110 includes multiple links 202 coupled together to form the drum shell kit 110. The links 202 are laid out on the ground surface 200 between a first end 204 of the drum shell kit 110 and a second end 206 of the drum shell kit 110. The first end 204 is defined by a first link 208 and the second end 206 is defined by a second link 210. It should be understood that all the links 202 are structurally identical. However, it may be possible that the drum shell kit 110 includes different types of the links 202 as well. The links 202 have similar structural features facilitating easy coupling and decoupling of the multiple links 202 with each other to assemble and disassemble the drum shell kit 110 respectively.

Figure 3:
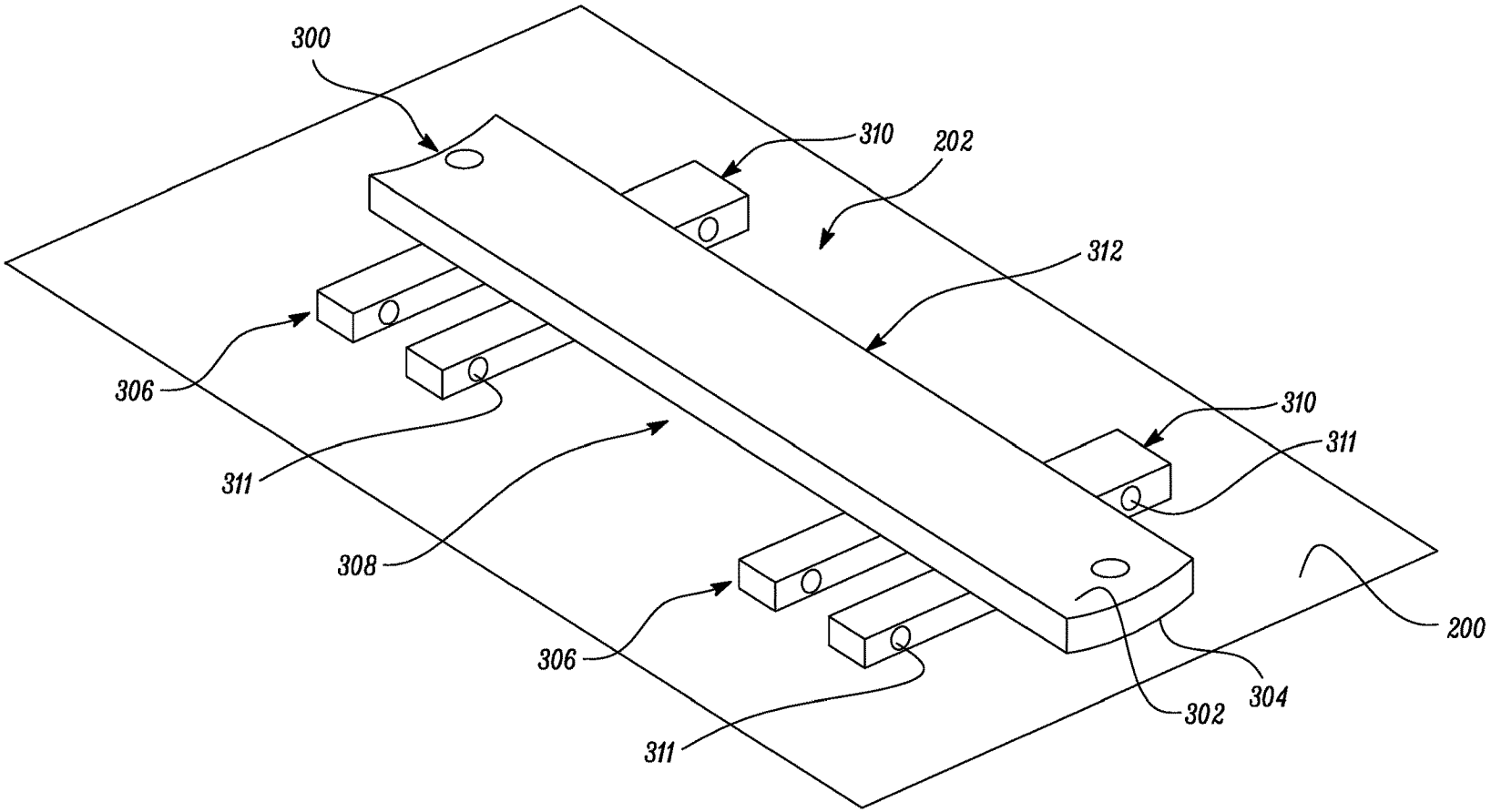
FIG. 3 is a perspective view of a single link of the drum shell kit, in accordance with an embodiment of the present disclosure.

Referring to FIG. 3, a single link 202 is illustrated. The link 202 includes a longitudinal member 300. The longitudinal member 300 includes an inner surface 302 and an outer surface 304. When the drum shell kit 110 is coupled to the compactor drum 102, the inner surface 302 of the longitudinal member 300 is in contact with the compactor drum 102 and the outer surface 304 of the longitudinal member 300 is in contact with the ground surface 200. The inner surface 302 is slightly curved so that when the drum shell kit 110 is wrapped around the compactor drum 102, the inner surface 302 grips the compactor drum 102 closely and there is no substantial gap between the drum shell kit 110 and the compactor drum 102. Curvature of the inner surface 302 of the longitudinal member 300 is complementary to curvature of the compactor drum 102. The link 202 includes first coupling members 306 coupled to the outer surface 304 and extending towards a first side 308 of the longitudinal member 300. In the illustrated embodiment, two first coupling members 306 are coupled to the longitudinal member 300. However, any number of the first coupling members 306 may be attached to the outer surface 304 at suitable positions towards the first side 308 of the longitudinal member 300.

The link 202 further includes second coupling members 310 coupled to the outer surface 304 and extending towards a second side 312 of the longitudinal member 300. In the illustrated embodiment, two second coupling members 310 are coupled to the outer surface 304 of the longitudinal member 300. However, any number of the second coupling members 310 may be attached to the outer surface 304 at suitable positions towards the second side 312 of the longitudinal member 300. Further, the second coupling members 310 are coupled to the outer surface 304 towards the second side 312 of the longitudinal member 300 at corresponding positions at which the first coupling members 306 are coupled to the outer surface 304 of the longitudinal member 300 towards the first side 308.

Figure 4:
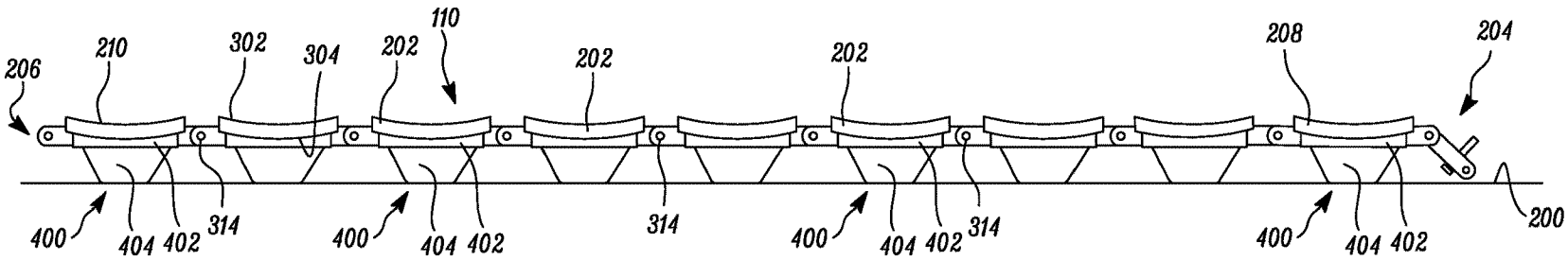
FIG. 4 is a side view of the drum shell kit, in accordance with an embodiment of the present disclosure.

Referring to FIG. 4, a side view of the drum shell kit 110 is illustrated. A cleat assembly 400 is coupled to the outer surface 304 of the links 202. The cleat assembly 400 may also be called as a padfoot assembly. The cleat assembly 400 includes a cleat pad 402 coupled to the outer surface 304 of the link 202. The cleat pad 402 may be coupled to the outer surface 304 of the link 202 through any suitable mechanical joining means such as welding, mechanical fasteners, adhesive etc. Any other suitable joining means may be used to attach the cleat pad 402 to the outer surface 304 of the link 202 as per application requirements. A cleat 404 is coupled to the cleat pad 402. The cleat 404 may be coupled to the cleat pad 402 through any suitable mechanical joining means such as welding, mechanical fasteners, adhesive etc. Any other suitable joining means may be used to attach the cleat 404 to the cleat pad 402 as per application requirements. The cleat 404 may have a frusto-conical shape as illustrated. However, it should be understood that the cleat 404 may be provided in any other shape as well as per application requirements. Any suitable number of cleat assemblies 400 may be attached to the longitudinal member 300 as per application requirements.

With combined reference to FIGS. 2-4, the drum shell kit 110 is formed by coupling the multiple links 202 together. The links 202 are coupled together through the first coupling members 306 and the second coupling members 308. The first coupling members 306 of the link 202 get coupled with second coupling member 310 of another adjacent link 202 located towards the first side 308 of the link 202. Similarly, the second coupling members 310 of the link 202 get coupled with the first coupling members 306 of another link 202 towards the second side 312 of the link 202. The first coupling members 306 and the second coupling members 310 are coupled to each other through mechanical fasteners 314. The first coupling members 306 and the second coupling members 310 include holes 311 to allow a mechanical fastener such as a bolt to pass through. The bolt may be locked by a nut to hold the first coupling member 306 and the second coupling member 310 together. Thus, the multiple links 202 are coupled to each other between the first end 204 and the second end 206.

Figure 5:
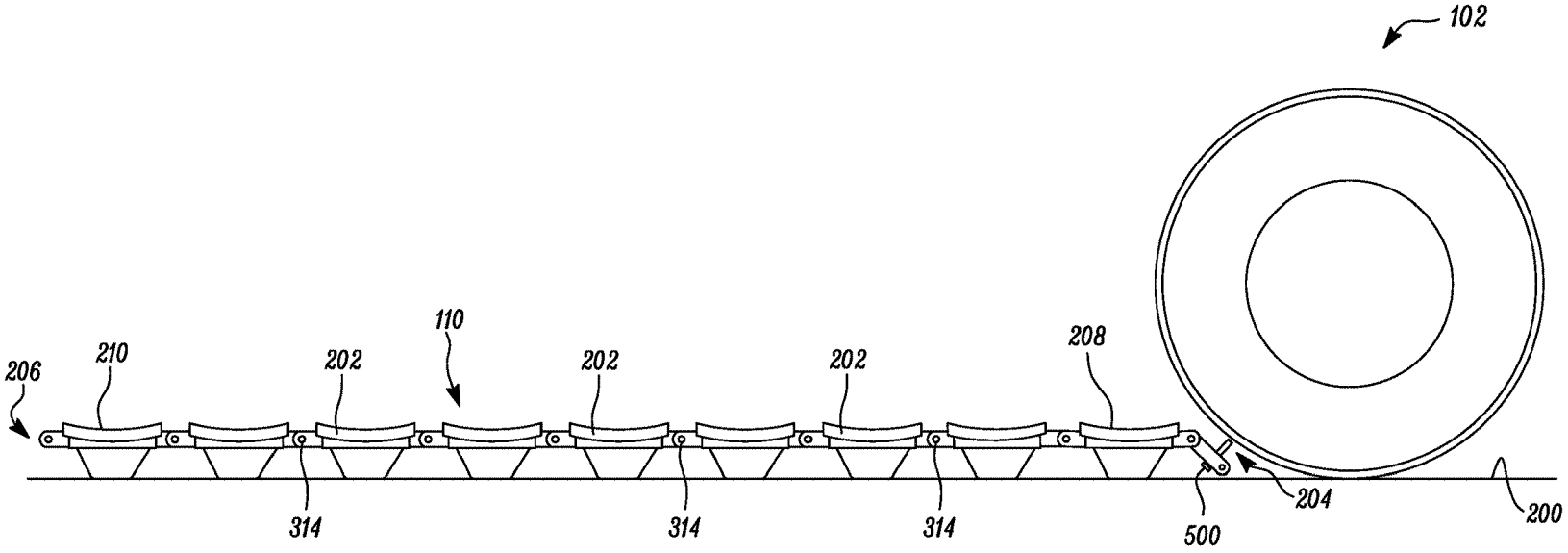
FIG. 5 is a side view of the compactor drum placed close to the drum shell kit, in accordance with an embodiment of the present disclosure.

FIGS. 5-9 illustrate process of coupling the drum shell kit 110 with the compactor drum 102. Referring to FIG. 5, the drum shell kit 110 is laid out on the ground surface 200 with the first link 208 at the first end 204 and the second link 210 at the second end 206. The compactor machine 100 is driven closer towards the first end 204 of the drum shell kit 110 such that the compactor drum 102 is placed near the first link 208. For the sake of simplifying the explanation, only the compactor drum 102 is illustrated instead of the compactor machine 100. A fastener 500 is coupled to the first link 208 to attach the first link 208 with the compactor drum 102. The compactor drum 102 may include a hole or a slot to accommodate the fastener 500 and attach the first link 208 of the drum shell kit 110 to the compactor drum 102.

Figure 6:
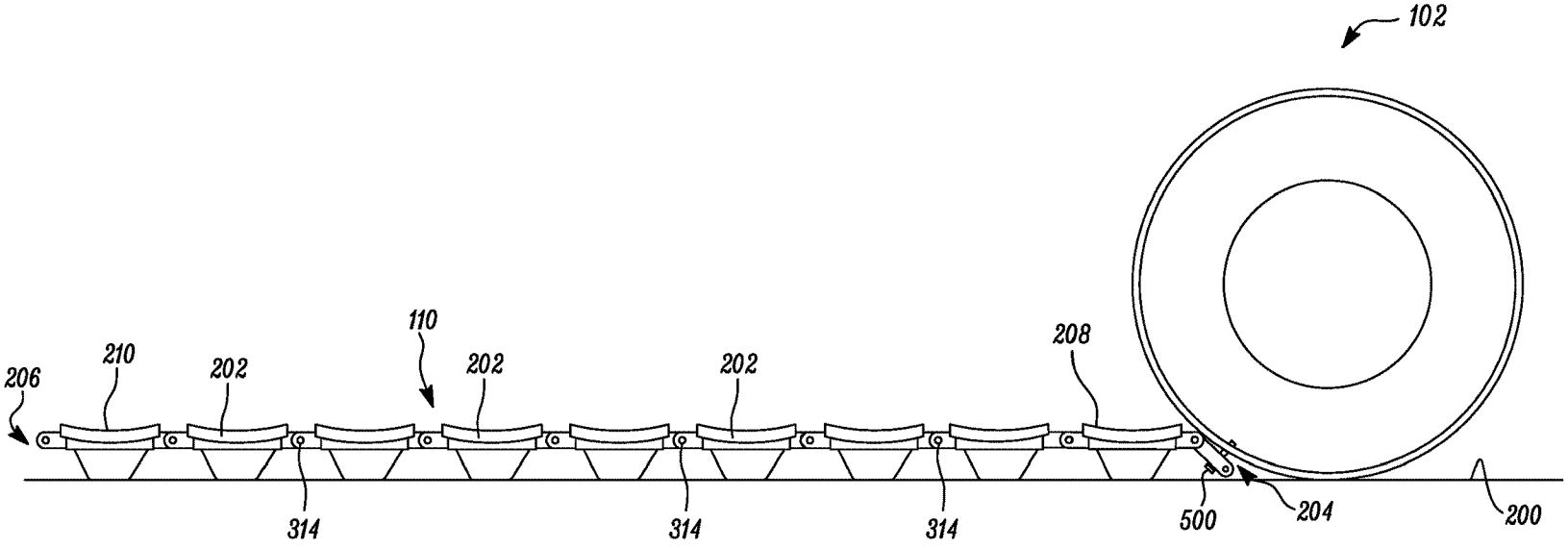
FIG. 6 is a side view of the compactor drum coupled to a first link of the drum shell kit, in accordance with an embodiment of the present disclosure.

Referring to FIG. 6, once the compactor drum 102 is close enough to the first end 204 of the drum shell kit 110, the first link 208 is coupled to the compactor drum 102 through the fastener 500. The first link 208 may be coupled to the compactor drum 102 in any other manner as well which may suit the application requirements. It should be understood that the first link 208 should be coupled to the compactor drum 102 in a removable manner facilitating easy assembly and disassembly of the drum shell kit 110 to the compactor drum 102. Also, it may be possible that all the links 202 may be coupled to the compactor drum 102 through individual fasteners 500 for each link 202 as per application requirements.

Figure 7:
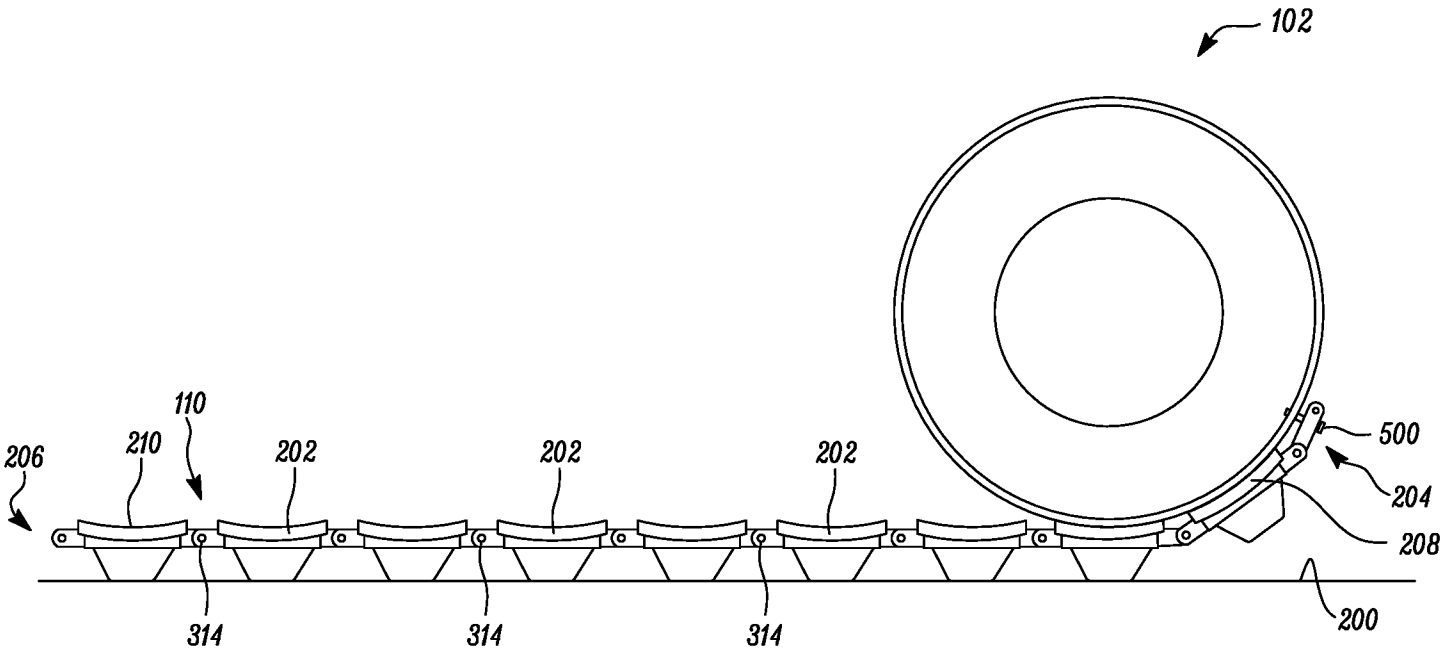
FIG. 7 is a side view of the compactor drum driving over the drum shell kit, in accordance with an embodiment of the present disclosure.

Referring to FIG. 7, once the first link 208 is coupled to the compactor drum 102, the compactor machine 100 drives over the drum shell kit 110 such that the compactor drum 102 sequentially comes into contact with the links 202 starting from the first link 208 at the first end 204 and moves towards the second link 210 at the second end 206. As the compactor drum 102 moves from the first end 204 towards the second end 206, the links 202 get wrapped around circumference of the compactor drum 102.

Figure 8:
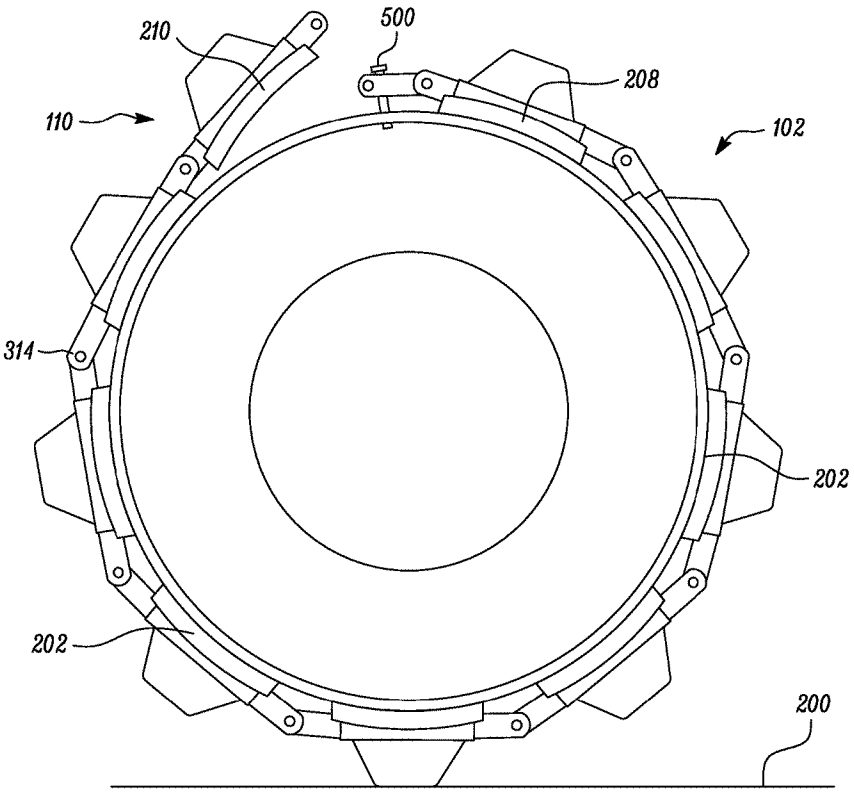
FIG. 8 is a side view of the drum shell kit wrapped around the compactor drum except one link, in accordance with an embodiment of the present disclosure.
Figure 9:
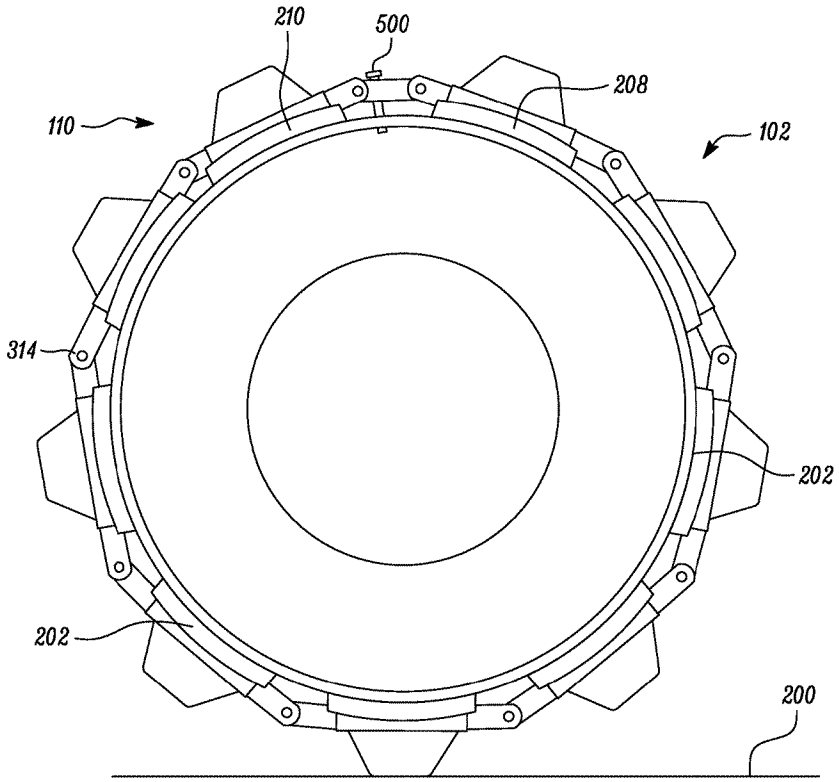
FIG. 9 is a side view of the compactor drum with the drum shell kit wrapped around the compactor drum, in accordance with an embodiment of the present disclosure.

With combined reference to FIGS. 8 & 9, as all the links 202 get wrapped around the circumference of the compactor drum 102, the second link 210 comes adjacent to the first link 208. The second link 210 is then coupled to the first link 208 through the second coupling member 310 of the second link 210 and the first coupling member 306 of the first link 208 being coupled through the mechanical fastener 314. As the first link 208 is coupled to the compactor drum 102, and the links 202 of the drum shell kit 110 are connected to each other, the drum shell kit 110 get coupled to the compactor drum 102.

Further, the drum shell kit 110 can be easily removed from the compactor drum 102. To remove the drum shell kit 110, the mechanical fastener 314 between the links 202, and near the fastener 500 may be removed and the compactor machine 100 may be driven so that the drum shell kit 110 decouples from the compactor drum 102. Process to couple the drum shell kit 110 to the compactor drum 102 may be performed in reverse order to perform the removal of the drum shell kit 110 from the compactor drum 102.

INDUSTRIAL APPLICABILITY

Figure 10:
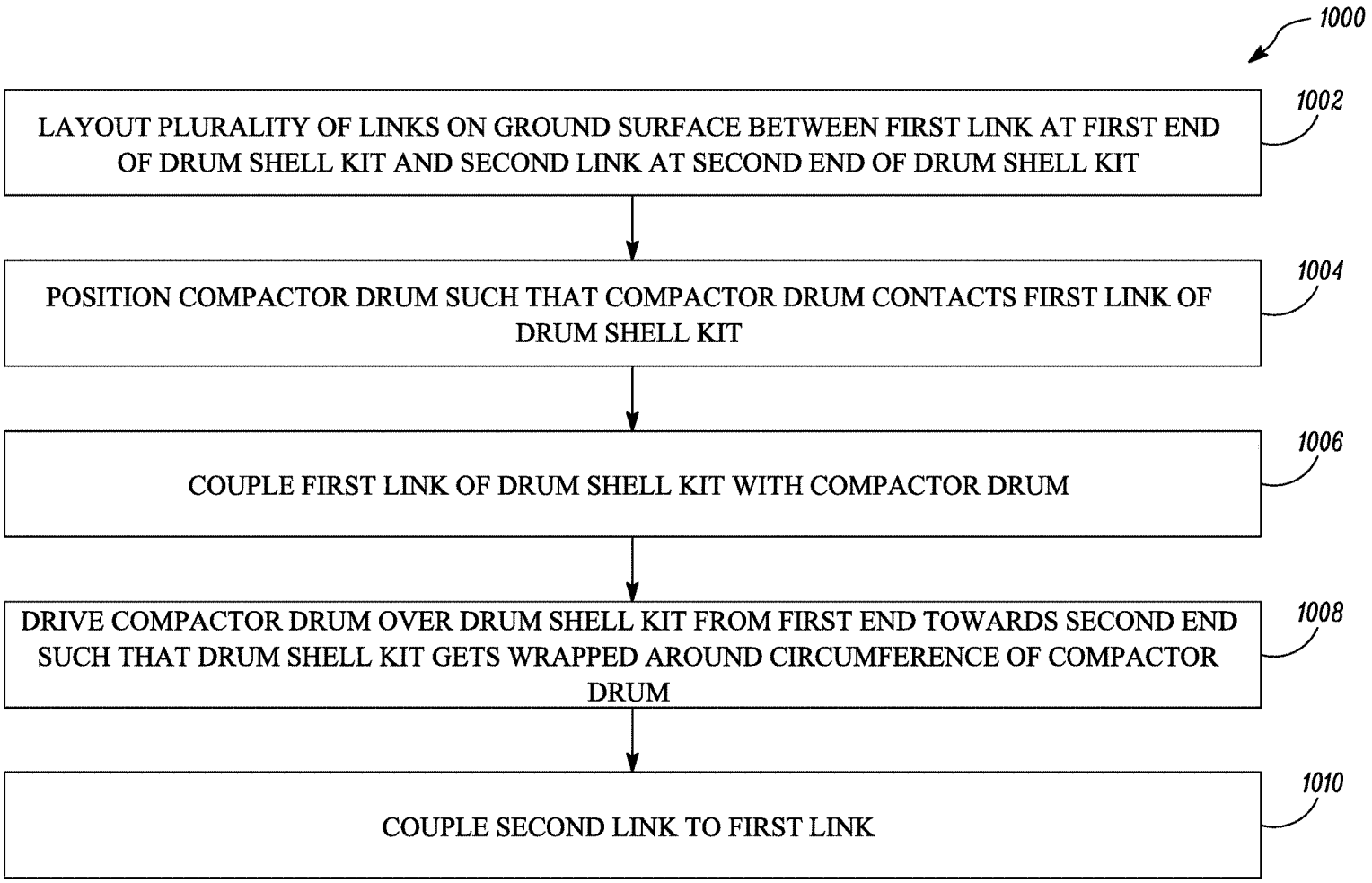
FIG. 10 is a flowchart of a method depicting steps of coupling the drum shell kit to the compactor drum, in accordance with an embodiment of the present disclosure.

The present disclosure provides an improved method 1000 to couple the drum shell kit 110 to the compactor drum 102. The method 1000 is explained through a flow chart depicted in FIG. 10. The method 1000 at step 1002 lays out the multiple links 202 between the first link 208 at the first end 204 of the drum shell kit 110 and the second link 210 at the second end 206 of the drum shell kit 100. The link 202 includes the longitudinal member 300 having the inner surface 302 and the outer surface 304.

The compactor drum 102 is mounted on the yoke 105. When the drum shell kit 110 is coupled to the compactor drum 102, the inner surface 302 of the longitudinal member 300 is in contact with the compactor drum 102 and the outer surface 304 of the longitudinal member 300 is in contact with the ground surface 200. The inner surface 302 is slightly curved and has the curvature complementary to the curvature of the compactor drum 102. The links 202 are laid out on the ground surface 200 such that the outer surface 304 is in contact with the ground surface 200.

The cleat assembly 400 is coupled to the outer surface 304 of the links 202. The cleat assembly 400 includes the cleat pad 402 coupled to the outer surface 304 of the link 202. The cleat 404 is coupled to the cleat pad 402. The method 1000 at step 1004 positions the compactor drum 102 such that the compactor drum 102 contacts the first link 208 of the drum shell kit 110. The compactor drum 102 is positioned close enough to the first link 208 of the drum shell kit 110 such that the compactor drum 102 may be coupled to the first link 208 of the drum shell kit 110.

The method 1000 at step 1006 couples the first link 208 of the drum shell kit 110 with the compactor drum 102. The first link 208 is coupled to the compactor drum 102 through the fastener 500. The first link 208 may be coupled to the compactor drum 102 in any other manner as well which may suit the application requirements. The method 1000 at step 1008 drives the compactor drum 102 over the drum shell kit 110 from the first end 204 towards the second end 206. As the compactor drum 102 drives over the drum shell kit 110, the links 202 get wrapped around the circumference of the compactor drum 102. When all the links 202 are wrapped around the compactor drum 102, the first link 208 comes adjacent to the second link 210. The method 1000 at step 1010 couples the second link 210 to the first link 208. All the links 202 are coupled to each other through the mechanical fasteners 314. Thus, the drum shell kit 110 is removably coupled to the compactor drum 102.

The present disclosure provides an improved structural design of the drum shell kit 110 to facilitate easy assembly and removal of the drum shell kit 110 to the compactor drum 102. The drum shell kit 110 can be coupled to the compactor drum 102 on the worksite, and there is no requirement for the compactor machine 100 to visit a workshop for performing the assembly/disassembly of the drum shell kit 110. Further, no heavy and complex tools are required to for performing the assembly/disassembly of the drum shell kit 110. Thus, the compactor machine 100 saves considerable downtime and subsequently saves costs which would have incurred while taking the compactor machine 100 to the workshop.

Further, as the drum shell kit 110 comprises of multiple links 202, there is no need to replace the drum shell kit 110 in case of wear of some parts of the drum shell kit 110. As all the links 202 are removably coupled with each other, the worn out links 202 may be easily replaced. The drum shell kit 110 does not take up a lot of storage space as well. As the links 202 are removably coupled, the links 202 may be stored on top of one another, hence saving a lot of storage space which may be used for other purposes. Overall, the present disclosure provides an efficient structural design as well as an effective method to assemble or disassemble the drum shell kit 110.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A removable drum shell kit adapted to convert a smooth compactor drum to a cleated compactor drum, the drum shell kit comprising:

a plurality of links coupled together to form the drum shell kit, the plurality of links including:

a longitudinal member having an inner surface adapted to contact the compactor drum and an outer surface adapted to contact a ground surface;

at least one cleat assembly coupled to the outer surface of the longitudinal member;

at least one first coupling member coupled to the outer surface of the longitudinal member, the first coupling member extending towards a first side of the longitudinal member; and at least one second coupling member coupled to the outer surface of the longitudinal member, the second coupling member extending towards a second side of the longitudinal member;

wherein the first coupling member is coupled to a corresponding second coupling member of another link towards the first side of the link, and the second coupling member is coupled to a corresponding first coupling member of another link towards the second side of the link, and wherein a fastener engages one of the plurality of links with the compactor drum to removably attach the drum shell kit to the compactor drum.

2. The drum shell kit of claim 1, wherein the cleat assembly includes:

a cleat pad coupled to the outer surface of the longitudinal member; and a cleat affixed to the cleat pad.

3. The drum shell kit of claim 1, wherein the longitudinal member has a curvature complementary to a curvature of the compactor drum.

4. The drum shell kit of claim 1, wherein the first coupling member is coupled to the corresponding second coupling member through a mechanical fastener.

5. The drum shell kit of claim 1, wherein the second coupling member is coupled to the corresponding first coupling member of another link through a mechanical fastener.

6. The drum shell kit of claim 1, wherein the compactor drum is mounted to a yoke of a compactor machine.

7. A compactor drum mountable on a yoke of a compactor machine, the compactor drum including:

drum supports mounted on the yoke;

pod housings mounted on the drum supports; and a removable drum shell kit adapted to be wrapped around the compactor drum and to convert a smooth compactor drum to a cleated compactor drum, and having a plurality of links coupled together, the plurality of links including:

a longitudinal member having an inner surface adapted to contact the compactor drum and an outer surface adapted to contact a ground surface;

at least one cleat assembly coupled to the outer surface of the longitudinal member;

at least one first coupling member coupled to the outer surface of the longitudinal member, the first coupling member extending towards a first side of the longitudinal member; and at least one second coupling member coupled to the outer surface of the longitudinal member, the second coupling member extending towards a second side of the longitudinal member;

wherein the first coupling member is coupled to a corresponding second coupling member of another link towards the first side of the link, and the second coupling member is coupled to a corresponding first coupling member of another link towards the second side of the link, and wherein a fastener engages one of the plurality of links with the compactor drum to removably attach the drum shell kit to the compactor drum.

8. The compactor drum of claim 7, wherein the cleat assembly includes:

a cleat pad coupled to the outer surface of the longitudinal member; and a cleat affixed to the cleat pad.

9. The compactor drum of claim 7, wherein the longitudinal member has a curvature complementary to a curvature of the compactor drum.

10. The compactor drum of claim 7, wherein the first coupling member is coupled to the corresponding second coupling member through a mechanical fastener.

11. The compactor drum of claim 7, wherein the second coupling member is coupled to the corresponding first coupling member of another link through a mechanical fastener.

12. A method for coupling a removable drum shell kit to a compactor drum and for converting a smooth compactor drum to a cleated compactor drum, the drum shell kit including a plurality of links coupled together, the method comprising:

laying out the plurality of links on a ground surface between a first link at a first end of the drum shell kit and a second link at a second end of the drum shell kit;

positioning the compactor drum such that the compactor drum contacts the first link of the drum shell kit;

coupling the first link of the drum shell kit with the compactor drum;

driving the compactor drum over the drum shell kit from the first end towards the second end such that the drum shell kit gets wrapped around a circumference of the compactor drum; and coupling the second link to the first link.

13. The method of claim 12, wherein the plurality of links include:

a longitudinal member having an inner surface adapted, to contact the compactor drum and an outer surface adapted to contact a ground surface;

at least one cleat assembly coupled to the outer surface of the longitudinal member;

at least one first coupling member coupled to the outer surface of the longitudinal member, the first coupling member extending towards a first side of the longitudinal member; and at least one second coupling member coupled to the outer surface of the longitudinal member, the second coupling member extending towards a second side of the longitudinal member.

14. The method of claim 13, wherein the first coupling member is coupled to a corresponding second coupling member of another link towards the first side of the link, and the second coupling member is coupled to a corresponding first coupling member of another link towards the second side of the link.

15. The method of claim 13, wherein the longitudinal member is laid on the ground surface such that the outer surface is facing the ground surface.

16. The method of claim 13, wherein the cleat assembly includes:

a cleat pad coupled to the outer surface of the longitudinal member; and a cleat affixed to the cleat pad.

17. The method of claim 13, wherein the longitudinal member has a curvature complementary to a curvature of the compactor drum.

18. The method of claim 12, wherein the first link of the drum shell kit is coupled with the compactor drum through a mechanical fastener.

19. The method of claim 12, wherein the first link is coupled to the second link through a mechanical fastener.

20. The method of claim 12, wherein the compactor drum is mounted on a yoke of a compactor machine.

* * * * *